US009085387B2

(12) United States Patent
Kurihara et al.

(10) Patent No.: US 9,085,387 B2
(45) Date of Patent: Jul. 21, 2015

(54) SYNTHETIC RESIN BOTTLE

(75) Inventors: Goro Kurihara, Tokyo (JP); Hiroaki Imai, Tokyo (JP); Tadayori Nakayama, Tokyo (JP); Junichi Itokawa, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 0 days.

(21) Appl. No.: 13/824,872

(22) PCT Filed: Sep. 22, 2011

(86) PCT No.: PCT/JP2011/071597

§ 371 (c)(1),
(2), (4) Date: Mar. 29, 2013

(87) PCT Pub. No.: WO2012/043371

PCT Pub. Date: Apr. 5, 2012

(65) Prior Publication Data

US 2013/0213926 A1 Aug. 22, 2013

(30) Foreign Application Priority Data

Sep. 30, 2010 (JP) ..... 2010-220706
Jul. 26, 2011 (JP) ..... 2011-163102

(51) Int. Cl.
*B65D 1/02* (2006.01)
*B65D 90/02* (2006.01)
*B65D 23/00* (2006.01)
(Continued)

(52) U.S. Cl.
CPC ..... *B65D 23/00* (2013.01); *A47G 19/2205* (2013.01); *B65D 1/0276* (2013.01); *B65D 79/005* (2013.01); *B65D 2501/0036* (2013.01)

(58) Field of Classification Search
USPC ..... 220/606, 608, 609, 623, 624, 635, 636; 215/371, 372, 373, 376, 377
See application file for complete search history.

(56) References Cited

U.S. PATENT DOCUMENTS 4,798,300 A * 1/1989 Ghosh et al. ..... 215/10
5,080,244 A * 1/1992 Yoshino ..... 215/375
(Continued)

FOREIGN PATENT DOCUMENTS

CA 1157785 A1 11/1983
CN 101005990 A 7/2007
(Continued)

OTHER PUBLICATIONS

Dec. 3, 2013 Notice of Allowance issued in Japanese Patent Application No. 2010-220706 (with translation).
(Continued)

*Primary Examiner* — Jeffrey Allen
*Assistant Examiner* — Jennifer Castriotta
(74) *Attorney, Agent, or Firm* — Oliff PLC

(57) ABSTRACT

The present invention relates to a bottle which is formed of a synthetic resin material into a cylindrical shape with a bottom. A bottom wall portion of a bottom of the bottle includes: a ground contact portion; a rising peripheral wall portion; a ring-shaped movable wall portion; and a depressed peripheral wall portion. The movable wall portion is rotatably disposed about a connecting part with the rising peripheral wall portion so as to move the depressed peripheral wall portion upward, and a concave and convex portion is formed over an entire circumference of the rising peripheral wall portion.

1 Claim, 6 Drawing Sheets

(51) Int. Cl.
*A47G 19/22* (2006.01)
*B65D 79/00* (2006.01)

(56) References Cited

U.S. PATENT DOCUMENTS

| | | | | |
|---|---|---|---|---|
| 6,635,217 | B1 * | 10/2003 | Britton | 264/532 |
| 6,942,116 | B2 * | 9/2005 | Lisch et al. | 215/373 |
| 2007/0084821 | A1 | 4/2007 | Bysick et al. | |
| 2008/0029523 | A1 * | 2/2008 | Tung et al. | 220/608 |
| 2011/0233166 | A1 | 9/2011 | Hiromichi et al. | |

FOREIGN PATENT DOCUMENTS

| | | |
|---|---|---|
| EP | 2 623 426 | 8/2013 |
| JP | 56-150712 | 11/1981 |
| JP | 2-1614 | 1/1990 |
| JP | 2004-276602 | 10/2004 |
| JP | 2008-132998 | 6/2008 |
| JP | 2009-018840 | 1/2009 |
| JP | 2010-126184 | 6/2010 |
| WO | WO 2010/061758 A1 | 6/2010 |

OTHER PUBLICATIONS

Dec. 13, 2011 International Search Report issued in International Application No. PCT/JP2011/071597.

Jun. 4, 2014 Office Action issued in Chinese Patent Application No. 201180046839.3 (with partial translation).

Feb. 25, 2014 Extended European Search Report issued in European Patent Application No. 11828928.9.

* cited by examiner

SYNTHETIC RESIN BOTTLE

TECHNICAL FIELD

The present invention relates to a bottle. Priority is claimed on Japanese Patent Application No. 2010-220706, filed Sep. 30, 2010 and Japanese Patent Application No. 2011-163102, filed Jul. 26, 2011, the contents of which are incorporated herein by reference.

BACKGROUND ART

As a bottle formed of a synthetic resin material into a cylindrical shape with a bottom, a bottle in which a bottom wall portion at the bottom includes a ground contact portion positioned at an outer circumferential edge portion, a rising peripheral wall portion connected to the ground contact portion from the inner side of the bottle radial direction and extending upward, a movable wall portion projecting from the upper end portion of the rising peripheral wall portion toward the inner side of the bottle radial direction, and a depressed peripheral wall portion extending upward from the inner end portion of the movable wall portion in the bottle radial direction as disclosed in Patent Documents 1 and 2 below, for example, has been known. The movable wall portion absorbs depressurization in the bottle by revolving about a connecting portion to the rising peripheral wall portion so as to cause the depressed peripheral wall portion to move upward.

CITATION LIST

Patent Document

[PTL 1] PCT International Publication No. WO2010/061758

[PTL 2] Japanese Unexamined Patent Application, First Publication No. 2010-126184

SUMMARY OF INVENTION

Technical Problem

According to such a conventional bottle, however, there is a case in which a part with a different appearance from those at the other parts partially occurs at the lower end portion or the like of the bottle, for example, when a user views the bottom from the outside of the bottle that is filled with contents such as seasoning like soy source or beverage.

Thus, the present invention was made in view of the above circumstance, and the first object is to provide a bottle capable of suppressing a feeling of incongruity that is given to a user when the user views a bottom from the outside of a bottle that is filled with contents.

In such a conventional bottle, there is also room for improvement in performance of absorbing depressurization in the bottle.

Thus, the present invention was also made in view of the above circumstance, and the second object is to provide a bottle capable of improving the performance of absorbing depressurization in the bottle.

Solution to Problem

In order to achieve the above first and second objects, the present invention proposes the following measures. A first invention of the present invention relates to a bottle formed of a synthetic resin material into a cylindrical shape with a bottom. A bottom wall portion of the bottom of the bottle includes: a ground contact portion which is positioned at an outer circumferential edge portion; a rising peripheral wall portion which is connected to the ground contact portion from an inner side of a bottle radial direction and extends upward; a ring-shaped movable wall portion which protrudes from an upper end portion of the rising peripheral wall portion to the inner side of the bottle radial direction; and a depressed peripheral wall portion which extends upward from an inner end portion of the movable wall portion in the bottle radial direction. The movable wall portion is rotatably disposed about a connecting part with the rising peripheral wall portion so as to move the depressed peripheral wall portion upward, and a concave and convex portion is formed over an entire circumference of the rising peripheral wall portion.

According to the bottle of the first invention, the concave and convex portion is formed in the rising peripheral wall portion. For this reason, it is possible to suppress a feeling of incongruity given when a user views the bottom of the bottle filled with contents. That is, light incident on the rising peripheral wall portion is diffusely reflected by the concave and convex portion, or the concave and convex portion is also filled with the contents in the bottle, or the like, and so that a feeling of incongruity given when the user views the bottom of the bottle filled with the contents can be suppressed.

According to a second invention of the present invention, a lower end of a convex part of the concave and convex portion is connected to the ground contact portion from the inner side of the bottle radial direction in the bottle according to the first invention.

According to the bottle of the second invention, the lower end of the convex part of the concave and convex portion is connected to the ground contact portion from the inner side of the bottle radial direction. For this reason, it is possible to cause not only the ground contact portion but also the lower end of the convex part to be brought into contact with the grounding surface when the bottle is placed standing and to thereby improve standing stability of the bottle.

According to a third invention of the present invention, a plurality of vertical ribs which are depressed to the inner side of the bottle radial direction and opened upward are formed in a bottle circumferential direction in the rising peripheral wall portion in the bottle according to the first invention.

According to the bottle of the third invention, an effect of absorbing depressurization is improved since the depressed peripheral wall portion moves upward due to revolution of the movable wall portion during the depressurization in the bottle. It is considered that the effect can be achieved because a movable wall portion revolves about a connecting part with the rising peripheral wall portion in relation with increase or decrease in the diameter of the rising peripheral wall portion due to the movement of the upper end portion of the rising peripheral wall portion in the bottle radial direction.

That is, according to the bottle of the third invention, the plurality of concave vertical ribs which are opened upward are formed in the bottle circumferential direction in the rising peripheral wall portion, and therefore, an upper end portion side thereof easily moves in the bottle radial direction in a flexible manner. For this reason, it is possible to easily cause the movable wall portion to revolve downward during the contents filling and enhance a capacity of absorbing depressurization immediately after the filling by increasing the volume of the bottle. That is, the movable wall portion which has been deformed downward during the contents filling moves to the inside of the bottle in a depressurized state occurring after tight sealing and cooling. Since a large amount of this movement can be secured, it is possible to increase the capacity of absorbing depressurization.

Since the upper end portion of the rising peripheral wall portion easily moves in the bottle radial direction in a flexible manner even after the contents filling, it is possible to vertically move the movable wall portion in a flexible manner while the movable wall portion is made to sensitively follow variations in the inner pressure in the bottle. It is possible to improve the performance of absorbing depressurization even in this point.

According to a fourth embodiment of the present invention, the verticals ribs are formed such that a circumferential length of the rising peripheral wall portion is within a range from 1.05 to 1.3 times as long as a circumferential length of the rising peripheral wall portion when the vertical ribs are not formed in the bottle according to the third embodiment.

According to the bottle of the fourth embodiment, the plurality of vertical ribs are formed in the rising peripheral wall portion so as to have an appropriate number, a rib width, and the like such that the circumferential length of the rising peripheral wall portion is within the above range. For this reason, it is possible to stably move the upper end portion of the rising peripheral wall portion in the bottle radial direction while securing ease of molding of the bottle and improve the performance of absorbing depressurization.

Advantageous Effects of Invention

According to the bottle of the present invention, it is possible to suppress a feeling of incongruity that is given when a bottom of the bottle filled with contents is viewed from the outside. Moreover, according to the bottle of the present invention, it is possible to improve a performance of absorbing depressurization in the bottle.

DESCRIPTION OF EMBODIMENTS (First Embodiment)

Hereinafter, description will be given of a first embodiment of the present invention with reference to the drawings.

Figure 1:
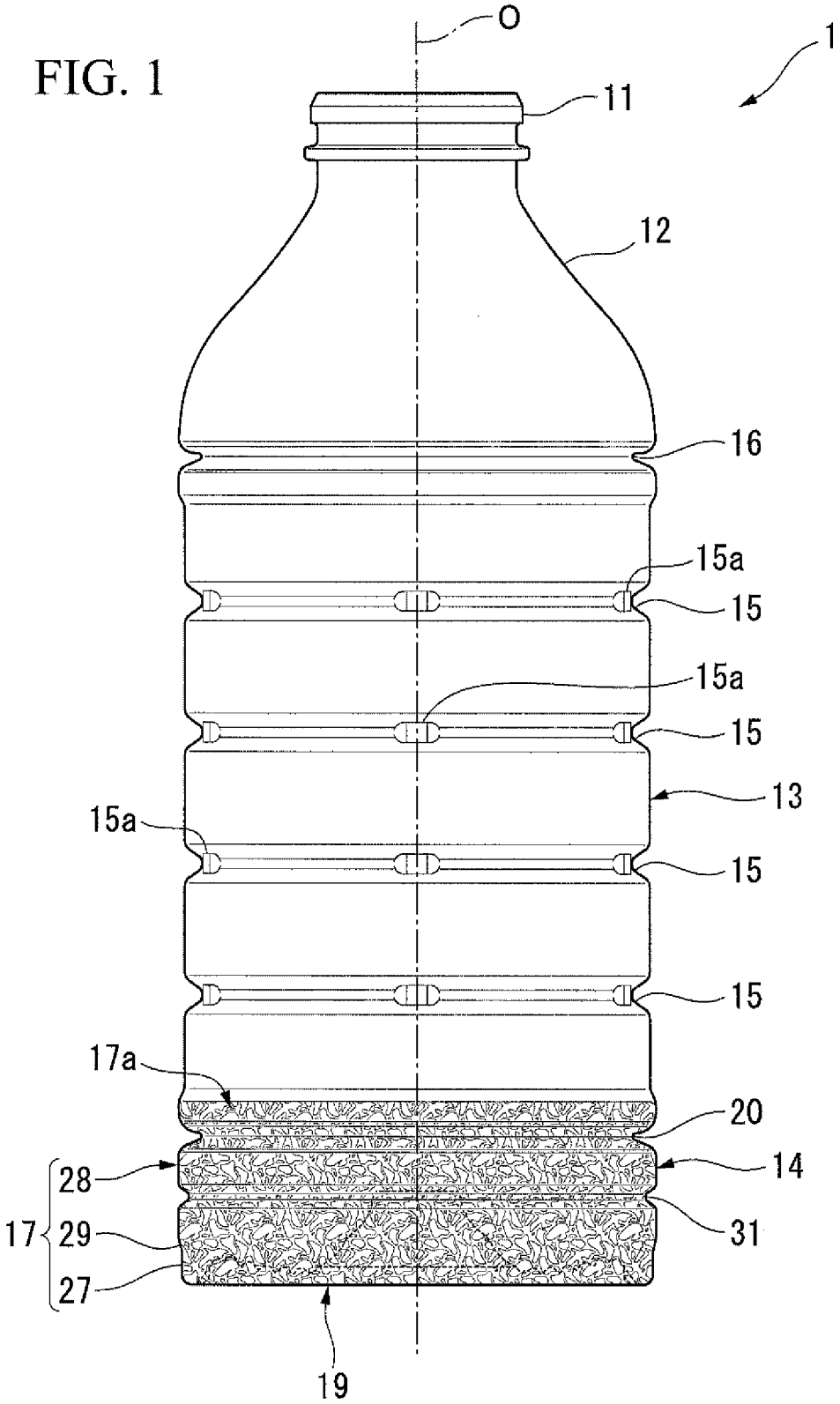
FIG. 1 is a side view of a bottle according to a first embodiment of the present invention.
Figure 2:
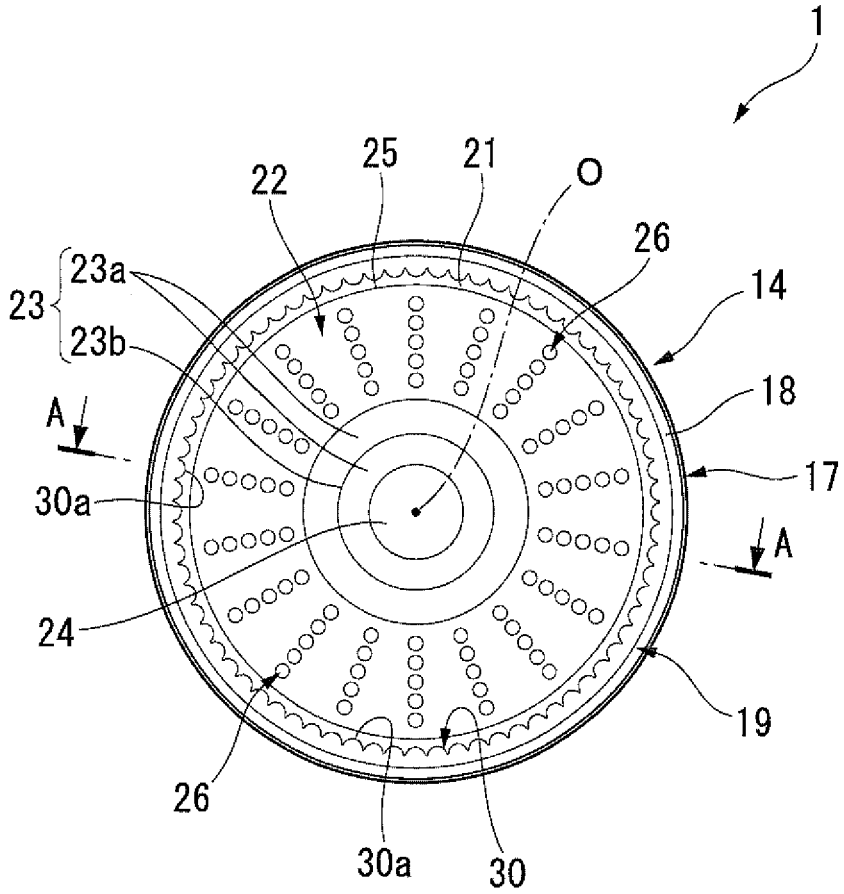
FIG. 2 is a bottom view of the bottle shown in FIG. 1.
Figure 3:
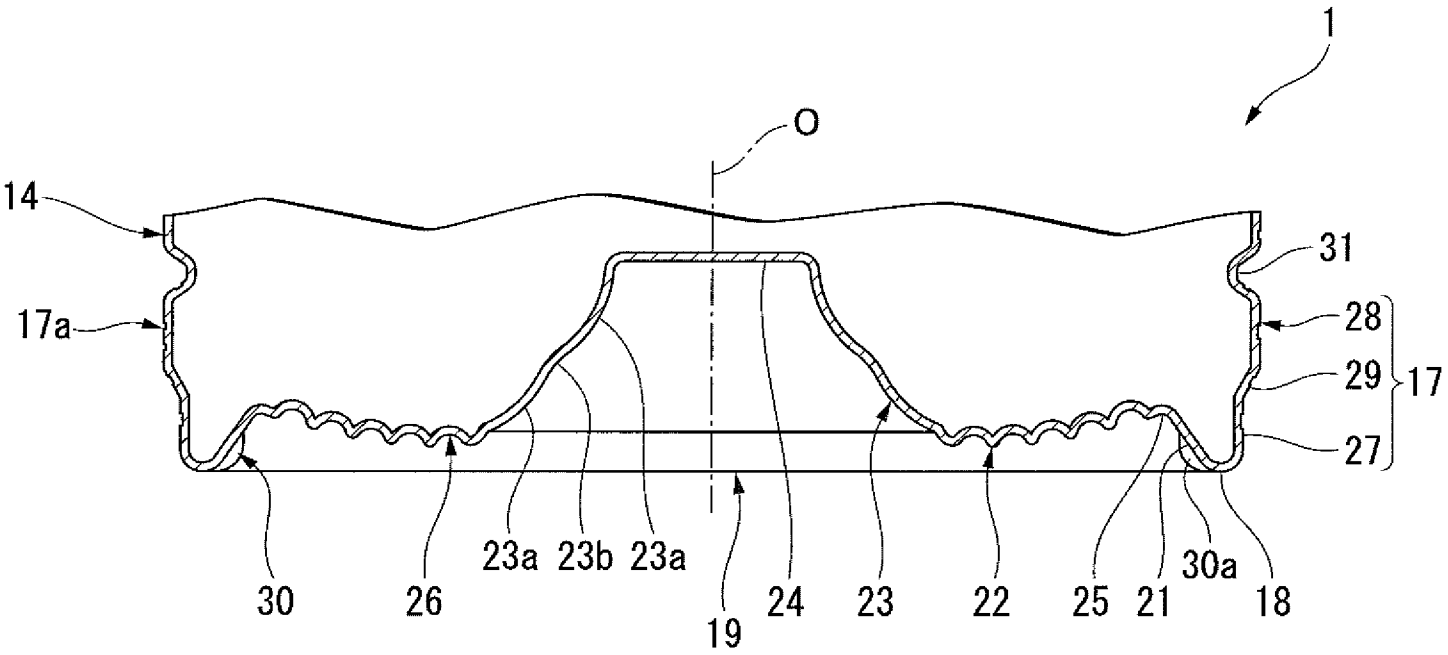
FIG. 3 is a vertical cross-sectional view of the bottle taken along line A-A shown in FIG. 2.

As shown in FIGS. 1 to 3, a bottle 1 according to the embodiment includes a mouth portion 11, a shoulder portion 12, a body portion 13, and a bottom 14. The mouth portion 11, the shoulder portion 12, the body portion 13, and the bottom 14 are sequentially provided in this order in a state in which center axes thereof are respectively positioned on a common axis.

Hereinafter, the common axis is referred to as a bottle axis O, a side of the mouth portion 11 in a direction of the bottle axis O is referred to as an upper side, a side of the bottom 14 in a direction of the bottle axis O is referred to as a lower side, a direction which is perpendicular to the bottle axis O is referred to as a bottle radial direction, a direction orbiting about the bottle axis O is referred to as a bottle circumferential direction.

In addition, the bottle 1 is formed by blow-molding a pre-form, which has been formed into a cylindrical shape with a bottom by injection molding, and is integrally formed of a synthetic resin material. Moreover, a cap which is not shown in the drawings is attached to the mouth portion 11. Furthermore, horizontal cross-sectional shapes of the mouth portion 11, the shoulder portion 12, the body portion 13, and the bottom 14, which are perpendicular to the bottle axis O, are all circular shapes.

In addition, a first ring-shaped concave groove 16 is sequentially formed at a connecting portion between the shoulder portion 12 and the body portion 13 over an entire periphery thereof. The body portion 13 is formed into a cylindrical shape, and a part between both end portions of the body portion 13 in the direction of the bottle axis O is formed to have a smaller diameter than those of the both end portions. In the body portion 13, a plurality of second ring-shaped concave grooves 15 are sequentially formed over the entire periphery thereof at intervals in a direction toward the bottle axis O. In each of the second ring-shaped concave grooves 15, a plurality of reinforcing protrusions 15*a* are provided at intervals in the circumferential direction so as to protrude toward the outer side of the bottle radial direction. In each of the plurality of second ring-shaped concave grooves 15, positions, at which the plurality of reinforcing protrusions 15*a* are disposed, in the bottle circumferential direction are equally set. In addition, the reinforcing protrusions 15*a* are positioned in a further inner side in the bottle radial direction than the outer circumferential surface of the body portion 13.

A third ring-shaped concave groove 20 is sequentially formed at the connecting portion between the body portion 13 and the bottom 14 over the entire circumferential thereof. The bottom 14 is formed into a cup shape and includes a heel portion 17 with an upper end opening portion which is connected to a lower end opening portion of the body portion 13 and a bottom wall portion 19 which blocks a lower end opening portion of the heel portion 17 and includes a ground contact portion 18 at an outer circumferential edge portion thereof. A fourth ring-shaped concave groove 31 is sequentially formed in the heel portion 17 over the entire circumference thereof. However, a depth of the fourth ring-shaped concave groove 31 is shallower than the depth of the third ring-shaped concave groove 20. Moreover, a concave and convex portion 17*a* is formed over the entire outer circumferential surface of the heel portion 17 and over the outer circumferential surface of the lower end portion of the body portion 13 in the embodiment. According to this, when multiple bottles 1 are made to sequentially stand and transported in a filling process, occurrence of a situation in which outer circumferential surfaces of the heel portions 17 and outer circumferential surfaces of the lower end portions of the body portions 13 of adjacent bottles 1 are in close contact with each other and the bottles 1 do not easily slide (blocking) is suppressed. In the example shown in the drawing, the concave and convex portions 17*a* are also formed on the surface of the third ring-shaped concave groove 20 and the surface of the fourth ring-shaped concave groove 31.

As shown in FIG. 3, the bottom wall portion 19 includes a rising peripheral wall portion 21 connected to the ground contact portion 18 from the inner side of the bottle radial direction and extending upward, a ring-shaped movable wall portion 22 projecting from the upper end portion of the rising peripheral wall portion 21 toward the inner side of the bottle radial direction, and a depressed peripheral wall portion 23 extending upward from the inner end portion of the movable wall portion 22 in the bottle radial direction.

The diameter of the rising peripheral wall portion 21 is gradually reduced from the lower side to the upper side.

The movable wall portion 22 is formed into a curved surface shape which protrudes downward and extends so as to gradually incline downward from the outer side to the inner side of the bottle radial direction. The movable wall portion 22 and the rising peripheral wall portion 21 are coupled to each other through a curved surface portion 25 which protrudes upward. In addition, the movable wall portion 22 is designed to freely revolve about the curved surface portion (the connecting part between the movable wall portion 22 and the rising peripheral wall portion 21) 25 so as to cause the depressed peripheral wall portion 23 move upward. A plurality of ribs 26 is radially disposed about the bottle axis O in the movable wall portion 22 as shown in FIG. 2. In the example shown in the drawing, the ribs 26 are intermittently and straightly extend in the bottle radial direction. The ribs 26 are depressed toward the upper side of the bottle.

The depressed peripheral wall portion 23 is coaxially disposed with the bottle axis O, and the diameter thereof is gradually increased from the upper side to the lower side as shown in FIG. 3. A disk-shaped apex wall 24 which is coaxially arranged with the bottle axis O is connected to the upper end portion of the depressed peripheral wall portion 23, and the depressed peripheral wall portion 23 and the apex wall 24 form a cylindrical shape with an apex as a whole. In addition, the depressed peripheral wall portion 23 is formed to have a circular horizontal cross-sectional view. In addition, in the depressed peripheral wall portion 23, a plurality of curved wall portions 23*a*, each of which is formed into a curved surface shape that protrudes inner side of the bottle radial direction, are sequentially formed via bent portions 23*b* in the direction of the bottle axis O.

In the first embodiment, a concave and convex portion 30 is formed over the entire circumference of the rising peripheral wall portion 21. The concave and convex portion 30 is designed such that a protrusion (convex part) 30*a* which is formed into a curved surface shape that protrudes toward the inner side of the bottle radial direction when viewed from the bottom of the bottle 1 as shown in FIG. 2 is sequentially provided in the bottle circumferential direction. In addition, the lower end of the protrusion 30*a* is connected to the ground contact portion 18 from the inner side of the bottle radial direction as shown in FIG. 3. Moreover, the upper end of the protrusion 30*a* is positioned at a lower side than the upper end of the rising peripheral wall portion 21. Furthermore, the end of the protrusion 30*a* on the inner side in the bottle radial direction is positioned at a further outer side than the curved surface portion 25 for connecting the movable wall portion 22 and the rising peripheral wall portion 21 in the bottle radial direction. In addition, the inner surface of the protrusion 30*a* which is positioned inside the bottle 1 is formed into a curved surface shape which is depressed toward the inner side of the bottle radial direction.

In the heel portion 17, a heel lower end portion 27 which is connected to the ground contact portion 18 from the outer side of the bottle radial direction is formed to have a smaller diameter than that of an upper heel portion 28 which is connected to the heel lower end portion 27 from the upper side. The upper heel portion 28 is connected to the body portion 13. In addition, the aforementioned fourth ring-shaped concave groove 31 is formed in the upper heel portion 28. Moreover, the diameter of a coupling part 29 between the heel lower end portion 27 and the upper heel portion 28 is gradually reduced from the upper side to the lower side. The coupling part 29 linearly extends in a direction inclined toward the bottle axis O in the vertical cross-sectional view. The upper end positions of the heel lower end portion 27 and the rising peripheral wall portion 21 are set to be equal to each other. A difference between the outer diameter of the heel lower end portion 27 and the outer diameter of the upper heel portion 28 is approximately 1.0 mm, for example.

As described above, since the concave and convex portion 30 is formed in the rising peripheral wall portion 21 in the bottle 1 according to the first embodiment, it is possible to suppress the feeling of incongruity that is given to a user when the user views the bottom 14 of the bottle 1 that is filled with contents. Specific examples of the feeling of incongruity includes a feeling caused because the color of the contents filled between the heel lower end portion 27 and the rising peripheral wall portion 21 is differently (lightly) viewed as compared with the other parts. In addition, since the lower end of the protrusion 30*a* of the concave and convex portion 30 is connected to the ground contact portion 18 from the inner side of the bottle radial direction, it is possible to cause not only the ground contact portion 18 but also the lower end of the protrusion 30*a* to be in contact with the ground contact surface when the bottle 1 is placed standing and to thereby improve the grounding stability of the bottle.

In addition, since the diameter of the heel lower end portion 27 is formed to be smaller than the diameter of the upper heel portion 28 in the heel portion 17, it is possible to suppress occurrence of a shrinkage cavity in the heel lower end portion 27 during the blow-molding of the bottle 1. As a result, it is possible to suppress deformation of the ground contact portion 18 which is connected to the heel lower end portion 27.

In addition, since the diameter of the coupling part 29 between the heel lower end portion 27 and the upper heel portion 28 is gradually reduced from the upper side to the lower side, a satisfactory molded property is secured while the aforementioned effects are reliably achieved.

In addition, the technical scope of the present invention is not limited to the first embodiment, and various modifications can be made without departing from the scope of the present invention.

For example, although the ribs 26 are formed in the movable wall portion 22 in the embodiment, the ribs 26 may not be formed. In addition, the ribs 26 may sequentially extend, extend in a curved manner, or project downward.

In addition, the mode of the concave and convex portion 30 formed in the ring peripheral wall portion 21 is not limited to the embodiment and may be appropriately changed.

In addition, the rising peripheral wall portion 21 may be appropriately changed so as to extend in parallel to the direction of the bottle axis O, for example.

In addition, the movable wall portion 22 may be appropriately changed so as to extend in parallel to the bottle radial direction, for example.

In addition, the depressed peripheral wall portion 23 may be appropriately changed so as to extend in parallel to the direction of the bottle axis O, for example, or the apex wall 24 may not be provided.

In addition, the concave and convex portion 17*a* may not be formed, and the reinforcing protrusions 15*a* may not be provided inside the second ring-shaped concave grooves 15.

In addition, the synthetic resin material for forming the bottle 1 may be appropriately changed to polyethylene terephthalate, polyethylene naphthalate, amorphous polyester, or a blend material thereof, or may be formed into a laminated structure, for example.

In addition, although the horizontal cross-sectional shapes of the shoulder portion 12, the body portion 13, and the bottom 14, which are perpendicular to the bottle axis O, are circular shapes in the embodiment, the horizontal cross-sectionals shapes thereof are not limited thereto and may be appropriately changed to polygonal shapes, for example.

Furthermore, the components in the above embodiment can be appropriately replaced with known components without departing from the scope of the present invention, and the above modified examples may be appropriately employed in combination.

(Second embodiment)

Hereinafter, description will be given of a bottle according to a second embodiment of the present invention with reference to the drawings.

(Configuration of Bottle)

Figure 4:
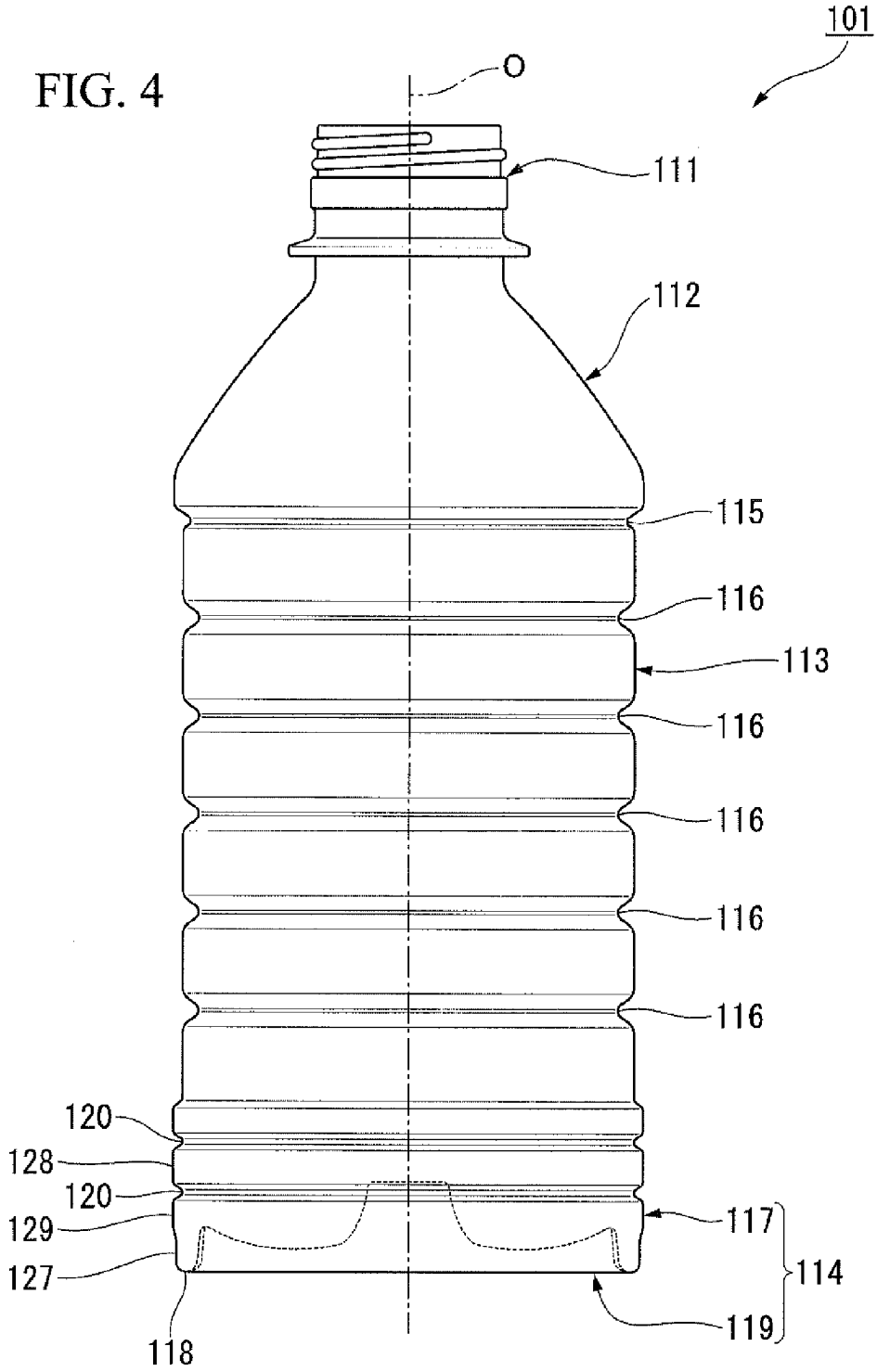
FIG. 4 is a side view of a bottle according to a second embodiment of the present invention.

A bottle 101 according to the embodiment includes a mouth portion 111, a shoulder portion 112, a body portion 113, and a bottom 114 as shown in FIG. 4. The mouth portion 111, the shoulder portion 112, the body portion 113, and the bottom 114 are sequentially provided in this order in a state in which the respective center axis lines are positioned on a common axis.

Hereinafter, the common axis is referred to as a bottle axis O, the side of the mouth portion 111 in the direction of the bottle axis O is referred to as an upper side, the side of the bottom 114 in the direction of the bottle axis O is referred to as a lower side, a direction which is perpendicular to the bottle axis O is referred to as a bottle radial direction, and a direction revolving about the bottle axis O is referred to as a bottle circumferential direction.

In addition, the bottle 101 is formed by blow-molding a pre-form which has been formed into a cylindrical shape with a bottom by injection molding and is integrally formed of a synthetic resin material. In addition, a cap which is not shown in the drawings is threadably mounded to the mouth portion 111. Moreover, the horizontal cross-sectional shapes of the mouth portion 111, the shoulder portion 112, the body portion 113, and the bottom 114 which are perpendicular to the bottle axis O are all circular shapes.

A first ring-shaped concave groove 115 is continuously formed over the entire circumferential of a connecting part between the shoulder portion 112 and the body portion 113. The body portion 113 is formed into a cylindrical shape to have a smaller diameter than the diameters of the lower end portion of the shoulder portion 112 and the heel portion 117 of the bottom 114 which will be described later. A plurality of second ring-shaped concave grooves 116 are formed in the body portion 113 at intervals in the direction of the bottle axis O. In the example shown in the drawing, five second ring-shaped concave grooves 116 are formed at equal intervals in the direction of the bottle axis O. Each of the second ring-shaped concave grooves 116 is a groove portion which is continuously formed over the entire circumference of the body portion 113.

The bottom 114 is formed into a cup shape and includes a heel portion 117 with an upper end opening portion which is connected to the lower end opening portion of the body portion 113 and a bottom wall portion 119 which blocks the lower end opening portion of the heel portion 117 and includes a ground contact portion 118 at the outer circumferential edge portion.

In the heel portion 117, a heel lower end portion 127 which is connected to the ground contact portion 118 from the outer side of the bottle radial direction is formed to have a smaller diameter than the diameter of an upper heel portion 128 connected to the heel lower end portion 127 from the upper side. Both the upper heel portion 128 and the lower end portion of the shoulder portion 112 are maximum outer diameter portions in the bottle 101.

In addition, the diameter of a coupling part 129 between the heel lower end portion 127 and the upper heel portion 128 is gradually reduced from the upper side to the lower side, and thus, the diameter of the heel lower end portion 127 is smaller than the diameter of the upper heel portion 128. A plurality of third ring-shaped concave groove 120 with approximately the same depth as that of the above first ring-shaped concave groove 115, for example, are continuously formed over the entire circumferential of the upper heel portion 128. In the example shown in the drawing, two third-ring-shaped concave grooves 120 are formed at an interval in the direction of the bottle axis O.

Figure 5:
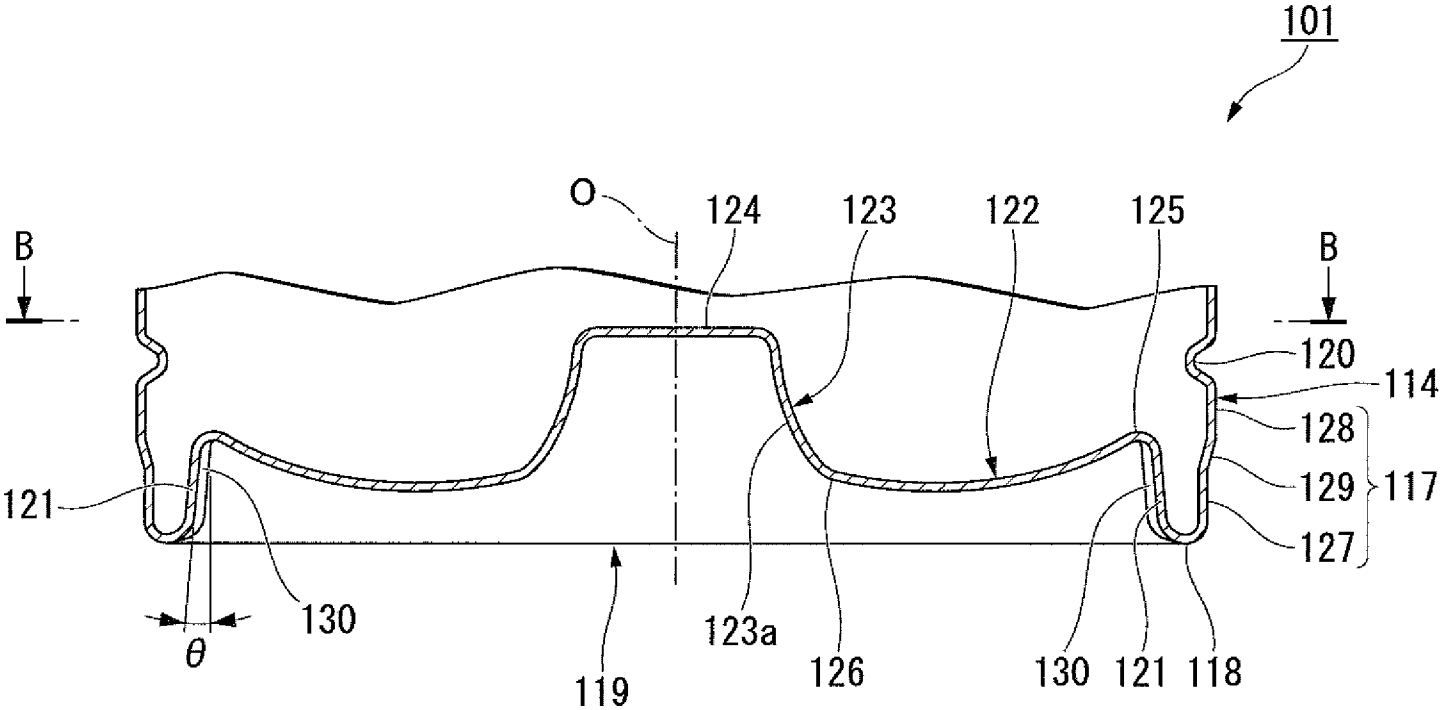
FIG. 5 is a vertical cross-sectional view in a vicinity of a bottom of the bottle shown in FIG. 4.

As shown in FIG. 5, the bottom wall portion 119 includes a rising peripheral wall portion 121 connected to the ground contact portion 118 from the inner side of the bottle radial direction and extending upward, a ring-shaped movable wall portion 122 projecting from the upper end portion of the rising peripheral wall portion 121 to the inner side of the bottle radial direction, and a depressed peripheral wall portion 123 extending upward from the inner end portion of the movable wall portion 122 in the bottle radial direction.

The movable wall portion 122 is formed into a curved surface shape which protrudes downward and extends so as to gradually incline downward from the outer side to the inner side of the bottle radial direction. The movable wall portion 122 and the rising peripheral wall portion 121 are coupled via a curved surface portion 125 which protrudes upward. In addition, the movable wall portion 122 is designed to be freely revolved about the curved surface portion (the connecting part between the movable wall portion 122 and the rising peripheral wall portion 121) 125 so as to cause the depressed peripheral wall portion 123 to move upward.

The diameter of the rising peripheral wall portion 121 is gradually reduced from the lower side to the upper side. Specifically, the rising peripheral wall portion 121 extends so as to gradually incline to the inner side of the bottle radial direction at an inclination angle θ with respect to the bottle axis O from the ground contact portion 118 to the curved surface portion 125 which is a connecting part with the movable wall portion 122.

Figure 6:
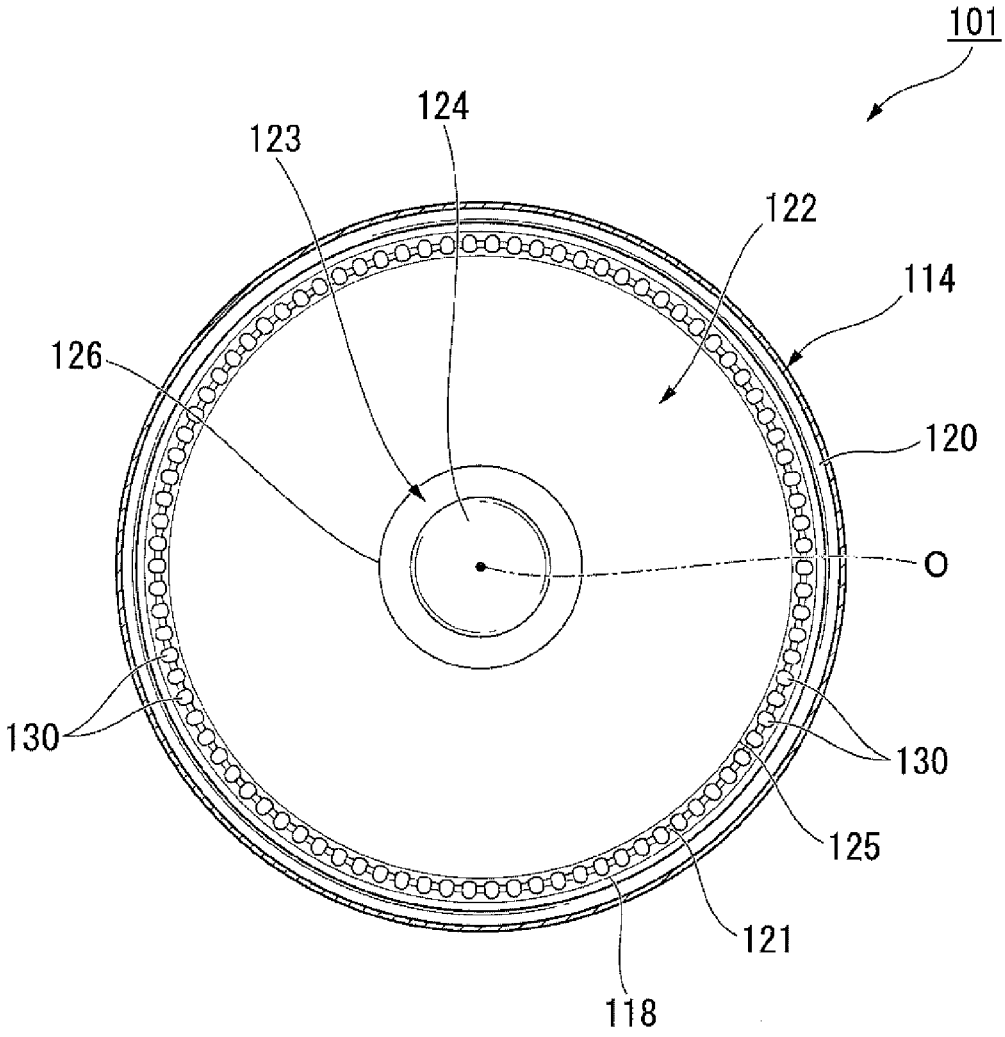
FIG. 6 is a horizontal cross-sectional view of the bottle taken along line B-B shown in FIG. 5.

As shown in FIGS. 5 and 6, a plurality of vertical ribs 130 are formed at constant interval in a bottle circumferential direction over the entire circumferential of the rising peripheral wall portion 121. Each of the vertical ribs 130 is a concave rib which is depressed to the inner side of the bottle radial direction and formed into a vertically long shape over a part from the ground contact portion 118 to the curved surface portion 125 which is the connecting part with the movable wall portion 122 (over the entire length of the rising height of the rising peripheral wall portion 121). In this occasion, the vertical ribs 130 are formed up to the curved surface portion 125, and therefore, the vertical ribs 130 are opened upward.

The depressed peripheral wall portion 123 is coaxially disposed with the bottle axis O, and the diameter thereof gradually increases from the upper side to the lower side, and the depressed peripheral wall portion 123 is formed into a circular shape in the horizontal cross-sectional view. A disc-shaped apex wall 124 which is coaxially arranged with the bottle axis O is connected to the upper end portion of the depressed peripheral wall portion 123, and the depressed peripheral wall portion 123 and the apex wall 124 form a cylindrical shape with an apex as a whole. The depressed peripheral wall portion 123 is formed into a curved surface shape which protrudes to the inner side of the bottle radial direction, and the upper end portion thereof includes a curved wall portion 123*a* which is sequentially provided at the outer circumferential edge portion of the apex wall 124. The lower end portion of the curved wall portion 123*a* is sequentially provided at the inner end portion of the movable wall portion 122 in the bottle radial direction via the curved surface portion 126 which protrudes downward.

(Actions of Bottle)

When the inside of the bottle 101 configured as described above is depressurized, the movable wall portion 122 revolves upward about the curved surface portion 125 such that the movable wall portion 122 moves to lift the depressed peripheral wall portion 123 upward. That is, it is possible to absorb variations in the inner pressure (depressurization) in the bottle 101 by actively deforming the bottle wall portion 119 of the bottle 101 during the depressurization.

Particularly, it is considered that the movable wall portion 122 revolves about the curved surface portion 125 in relation to increase and decrease in the diameter of the rising peripheral wall portion 121 by the movement of the upper end portion of the rising peripheral wall portion 121 in the bottle radiation direction during the depressurization. On this occasion, since the plurality of vertical ribs 130 which open upward are formed in the bottle circumferential direction in the rising peripheral wall portion 121 of the embodiment, the upper end portion side (the curved surface portion 125 side) easily moves in the bottle radial direction in a flexible manner. For this reason, it is possible to facilitate the revolving downward of the movable wall portion 122 during the filling of contents and enhance a capacity of absorbing depressurization immediately after the filing by increasing the volume of the bottle 101. Accordingly, it is possible to improve the performance of absorbing depressurization.

In addition, the movable wall portion 122 of the embodiment extends so as to be gradually positioned at a lower side from the curved surface portion 125 to the inner side of the bottle radial direction, and therefore, the movable wall portion 122 more easily revolves downward during the filling, and the performance of absorbing depressurization is easily improved in an effective manner.

Moreover, since the upper end portion of the rising peripheral wall portion 121 easily moves in the bottle radial direction in a flexible manner even after the filling of contents, it is possible to vertically move the movable wall portion 122 in a flexible manner while the movable wall portion 122 is made to sensitively follow the variations in the inner pressure in the bottle 1. It is possible to improve the performance of absorbing depressurization even in this point.

In addition, the bottle 101 of the embodiment has inner contents of not more than 1 liter and a grounding diameter of not more than 85 mm and is preferably used as a bottle (so-called heat-resistant bottle) used when a contents filling operation is performed at 80 to 100° C. (preferably at 85 to 93° C.). In addition, the bottle 101 of the embodiment can be used as a bottle used when the contents filling operation is performed at a temperature of not higher than 75° C. (more specifically, in a temperature range from 60 to 75° C.).

In addition, the technical scope of the present invention is not limited to the embodiment, and various modifications can be made without departing from the scope of the present invention.

For example, although the rising peripheral wall portion 121 is formed so as to gradually incline to the inner side of the bottle radial direction from the ground contact portion 118 to the curved surface portion 125 in the embodiment, the rising peripheral wall portion 121 may be formed so as to vertically stand from the ground contact portion 118 to the curved surface portion 125. However, it is more preferable that the rising peripheral wall portion 121 incline as in the embodiment.

In addition, although the plurality of vertical ribs 130 are formed at constant intervals over the entire circumference of the rising peripheral wall portion 121, the plurality of vertical ribs 130 may not be formed at constant intervals as long as the plurality of vertical ribs 130 are formed in the bottle circumferential direction. On this occasion, the plurality of vertical ribs 130 may be formed at intervals in the bottle circumferential direction or may be sequentially formed. However, since the upper end portion of the rising peripheral wall portion 121 is easily made to move in the bottle radial direction uniquely over the entire circumference, the vertical ribs 130 are preferably formed at constant intervals in the bottle circumferential direction.

In addition, although each vertical rib 130 is formed over the curved surface portion 125 from the ground contact portion 118 of the rising peripheral wall portion 121, the vertical rib 130 may be formed only on the side of the curved surface portion 125 as long as the vertical rib 130 is opened upward. Even in such a case, it is possible to flexibly move the upper end portion of the rising peripheral wall portion 121 in the bottle radial direction.

Moreover, the number of vertical ribs 130, the depths of each vertical rib 130, the rib interval between the vertical ribs 130 which are adjacent in the bottle circumferential direction, and the like may be determined depending on the size, the height, and the like of the rising peripheral wall portion 121. Particularly, it is preferable to form the vertical ribs 130 such that the circumferential length of the rising peripheral wall portion 121 including the vertical ribs 130 (the length of the bottle circumferential direction) is within a range of 1.05 to 1.3 times as long as the circumferential length in the case in which the vertical ribs 130 are not formed. In so doing, it is possible to stably move the upper end portion of the rising peripheral wall portion 121 in the bottle radial direction while securing ease of molding of the bottle 101 and improve the performance of absorbing depressurization. Detailed description will be given of this point in an example described later.

In the embodiment, the movable wall portion 122 may be appropriately changed so as to project in parallel to the bottle radial direction or incline upward, for example. In addition, the movable wall portion 122 may be appropriately changed so as to be in a planar shape or a concave curved surface shape which depressed upward, for example.

In addition, although each of the horizontal cross-sectional shapes of the shoulder portion 112, the body portion 113, and the bottom 114, which is perpendicular to the bottle axis O, is a circular shape in the embodiment, the horizontal cross-sectional shape is not limited thereto and may be appropriately changed to a polygonal shape or the like, for example.

In addition, the synthetic resin material forming the bottle 101 may be appropriately changed to polyethylene terephthalate, polyethylene naphthalate, amorphous polyester, or a blend material thereof Furthermore, the bottle 101 may be formed into a laminated structure with an intermediate layer as well as a single layer structure. In addition, examples of the intermediate layer include a layer formed of a resin material with a gas barrier property, a layer formed of a recycled material, a layer formed of a resin material with an oxygen absorption property, and the like.

Furthermore, the components in the second embodiment can be appropriately replaced with known components without departing from the scope of the present invention, and the above modified examples may be appropriately employed in combination.

EXAMPLES

Next, description will be given of an example of a test (analysis) for observing how the upper end portion of the rising peripheral wall portion 121 changes in the bottle radial direction during the filling of contents by changing the circumferential length of the rising peripheral wall portion 121 including the vertical ribs 130 by changing a combination of the number of the vertical ribs 130, the rib width, the rib intervals, and the like.

In this test, the rising peripheral wall portion in a case in which the vertical ribs 130 were not formed was regarded as a reference model, and the test result was evaluated by making comparison with the reference model. As the rising peripheral wall portion as the reference model, a rising peripheral wall portion which gradually inclined to the inner side of the bottle radial direction at an inclination angle θ from the ground contact portion 118 to the curved surface portion 125 as in the second embodiment was employed. On this occasion, the inclination angle θ was set to 5.2°. In addition, the length of the rising peripheral wall portion 121 in the bottle circumferential direction at the center in the vertical direction was regarded as a circumferential length. In addition, the height from the grounding surface to the uppermost portion of the curved surface portion 125 was set to 7.7 mm.

In this test, the following four patterns were respectively tested. In addition, although vertical ribs, each of which has a semicircular are-shaped horizontal cross section, was employed, vertical ribs with other shapes (a V shape, a trapezoidal shape, and the like) may be also used.

(1) As a first pattern, the above rising peripheral wall portion as the reference model in which 90 vertical ribs 30, each of which has a depth of 0.3 mm and a rib width of 0.6 mm, were formed at rib intervals of 4° about the bottle axis O was employed. The circumferential length in this case was 107.5% when the circumferential length of the reference model was regarded as 100%.

(2) As a second pattern, the above rising peripheral wall portion as the reference model in which 30 vertical ribs 130, each of which has a depth of 0.7 mm and a rib width of 1.4 mm, were formed at rib intervals of 12° about the bottle axis O was employed. The circumferential length in this case was 108.9% when the circumferential length of the reference model was regarded as 100%.

(3) As a third pattern, the above rising peripheral wall portion as the reference model in which 60 vertical ribs 30, each of which has a depth of 0.7 mm and a rib width of 1.4 mm, were formed at rib intervals of 6° about the bottle axis O was employed. The circumferential length in this case was 117.8% when the circumferential length of the reference model was regarded as 100%.

(4) As a fourth pattern, the above rising peripheral wall portion as the reference model in which 90 vertical ribs 30, each of which has a depth of 0.7 mm and a rib width of 1.4 mm, were formed at rib intervals of 4° about the bottle axis O was employed. The circumferential length in this case was 126.7% when the circumferential length of the reference model was regarded as 100%.

Predetermined inner pressure (0.5 kg/cm$^2$ (49 Kpa)) was applied to the inside of the bottles 101, each of which was provided with the rising peripheral wall portion 121 as the reference model or the rising peripheral wall portion 121 of one of the above four patterns, on the assumption of contents filling. Then, the movable wall portion 122 revolved downward about the curved surface portion 125, and the upper end portion of the rising peripheral wall portion 121 moved to the inner side of the bottle radial direction, in any of the bottles 101. That is, the rising peripheral wall portion 121 was deformed such that the inclination angle θ increased as compared with 5.2°.

The inclination angles θ after the deformation were 8.2° in the reference model, 8.7° in the first pattern, 8.9° in the second pattern, 9.4° in the third pattern, and 9.5° in the fourth pattern.

It was possible to confirm from these results that the rising peripheral wall portion 121 was able to incline at a greater inclination angle θ during the contents filling, for example, in a case in which the vertical ribs 130 were formed than in a case in which the vertical ribs 130 were not formed. That is, it was possible to confirm that the upper end portion side of the rising peripheral wall portion 121 was able to flexibly move in the bottle radial direction and the movable wall portion 122 was able to revolve downward. Particularly, it was possible to confirm that the above effect was significantly exhibited as a circumferential length ratio increased. In addition, it was possible to confirm that the above effect was achieved when the circumferential length of the rising peripheral wall portion 121 around which the vertical ribs 130 were formed was within a range from 1.05 to 1.3 times as long as the circumferential length of the rising peripheral wall portion 121 (reference model) around which the vertical ribs 130 were not formed, regardless of the depth, the rib width, the number, and the rib intervals of the vertical ribs 130.

In addition, it is considered to be difficult to expect the above effect if the circumferential length is less than 1.05 times as long as the circumferential length of the reference model even when the vertical ribs 130 are formed. In addition, it is considered that a further enhanced effect cannot be achieved (equilibrium situation) when the circumferential length is set to be greater than 1.3 times as the circumferential length of the reference model. In addition, since it is necessary to increase the number of vertical ribs 130 in order to increase the circumferential length, increasing in the circumferential length is difficult in terms of molding and not practical.

Industrial Applicability

According to the bottle of the present invention, it is possible to suppress a feeling of incongruity given when the bottom of the bottle is viewed from the outside of the bottle filled with contents. Furthermore, according to the bottle of the present invention, it is possible to improve a performance of absorbing depressurization in the bottle.

The invention claimed is:

1. A bottle formed of a synthetic resin material into a cylindrical shape with a bottom, a bottom wall portion of the bottom comprising:

a ground contact portion which is positioned at an outer circumferential edge portion of the bottom wall portion;

a rising peripheral wall portion which is connected to the ground contact portion and extends upward;

a ring-shaped movable wall portion which is connected to an upper end portion of the rising peripheral wall portion via a curved surface portion protruding upward, and which extends downward and toward a central longitudinal axis of the bottle; and a depressed peripheral wall portion which is connected to an inner end portion of the ring-shaped movable wall portion and extends upward, wherein the ring-shaped movable wall portion: (1) pivots about the curved surface portion so as to move the depressed peripheral wall portion upward, and (2) extends so as to gradually incline downward from the curved surface portion to a connecting part of the ring-shaped movable wall portion connecting with the depressed peripheral wall portion, thereby positioning the ring-shaped movable wall portion at a lower height than the curved surface portion, a concave and convex portion is formed over an entire circumference of the rising peripheral wall portion, each convex part of the concave and convex portion is a vertical rib of a plurality of vertical ribs, each of the vertical ribs protrudes toward the central longitudinal axis and opens upward, and the vertical ribs are formed such that a first circumferential length of the rising peripheral wall portion including the vertical ribs is within a range from 1.05 to 1.3 times as long as a second circumferential length of the rising peripheral wall portion exclusing the vertical ribs.

* * * * *